US005690739A

United States Patent [19]

Sassa et al.

[11] Patent Number: 5,690,739

[45] Date of Patent: Nov. 25, 1997

[54] RELEASE AGENT SUPPLY WICK FOR PRINTER APPARATUS AND METHOD FOR MAKING AND USING SAME

[75] Inventors: Robert L. Sassa, Newark, Del.; Alex R. Hobson; Elizabeth Marie Crowley, both of Elkton, Md.

[73] Assignee: W. L. Gore & Associates, Inc., Newark, Del.

[21] Appl. No.: 457,554

[22] Filed: Jun. 1, 1995

Related U.S. Application Data

[62] Division of Ser. No. 127,670, Sep. 28, 1993.

[51] Int. Cl.[6] ..... B05C 1/06; B05C 11/105

[52] U.S. Cl. ..... 118/260; 118/268; 219/216; 401/23; 401/88; 401/197; 428/36.91; 428/286; 428/290; 428/421; 428/906

[58] Field of Search ..... 118/60, 260, 264, 118/268; 401/23, 88, 96, 197; 355/284; 219/216; 427/429; 428/36.91, 421, 422, 906, 260, 286, 290; 492/51; 156/441.5

[56] References Cited

U.S. PATENT DOCUMENTS

| | | | |
|---|---|---|---|
| 2,500,573 | 3/1950 | Rockoff | 156/77 |
| 3,640,203 | 2/1972 | Raab et al. | 396/608 |
| 3,767,520 | 10/1973 | Dick et al. | 222/187 |
| 4,047,885 | 9/1977 | Hauman, Jr. | 399/325 |
| 4,141,314 | 2/1979 | Newson | 118/246 |
| 4,182,263 | 1/1980 | Naeser et al. | 118/60 |
| 4,283,448 | 8/1981 | Bowman | 428/34.9 |
| 4,309,957 | 1/1982 | Swift | 118/60 |
| 4,359,963 | 11/1982 | Saito et al. | 118/60 |
| 4,375,201 | 3/1983 | Kato | 118/60 |
| 4,458,625 | 7/1984 | Sakane et al. | 118/60 |
| 4,496,235 | 1/1985 | Tamary | 399/325 |
| 4,501,483 | 2/1985 | Romansky et al. | 399/325 |
| 4,573,428 | 3/1986 | Ogino et al. | 118/60 |
| 4,578,338 | 3/1986 | Gruber et al. | 430/120 |

(List continued on next page.)

FOREIGN PATENT DOCUMENTS

| | | |
|---|---|---|
| 0 137 129 | 4/1985 | European Pat. Off. . |
| 0 174 474 | 3/1986 | European Pat. Off. . |
| 0 183 903 | 6/1986 | European Pat. Off. . |
| 0 240 834 | 10/1987 | European Pat. Off. . |
| 0 450 894 | 10/1991 | European Pat. Off. . |
| 1 199 972 | 9/1965 | Germany . |
| 58-37541 | 8/1983 | Japan . |
| 58-42465 | 9/1983 | Japan . |
| 59-84273 | 5/1984 | Japan . |
| 60-22160 | 2/1985 | Japan . |
| 60-26973 | 2/1985 | Japan . |
| 86-023696 | 12/1985 | Japan . |
| 62-178992 | 8/1987 | Japan . |
| 62-52302 | 11/1987 | Japan . |
| 63-123077 | 5/1988 | Japan . |
| 63-172186 | 7/1988 | Japan . |
| 88-0243481 | 3/1990 | Japan . |
| 2-144587 | 6/1990 | Japan . |
| 93/08512 | 4/1993 | WIPO . |

OTHER PUBLICATIONS

ASTM F316–86; pp. 330–338; Pore Size Characteristics of Membrane Filters by Bubble Point and Mean Flow Pore Test.

*Primary Examiner*—Michael W. Ball
*Assistant Examiner*—Francis J. Lorin
*Attorney, Agent, or Firm*—Carol A. Lewis White

[57] ABSTRACT

An improved release agent delivery apparatus is disclosed for use in laser printers, plain paper copiers, facsimile machines, and similar printing apparatus. The delivery apparatus comprises an absorbent textile core filled with release agent, a permeable membrane surrounding the textile core to form a sheathed wick member, and a mounting sleeve adapted to attach the sheathed wick member in operative contact with the printer. The apparatus has numerous operational advantages over existing oil delivery apparatus, including providing multiple contact surfaces for longer operational life before replacement, ease in cleaning and regeneration, improved durability and reduced wear, and more compact and versatile operation.

9 Claims, 5 Drawing Sheets

U.S. PATENT DOCUMENTS

| | | | |
|---|---|---|---|
| 4,631,798 | 12/1986 | Ogino et al. | 29/458 |
| 4,633,805 | 1/1987 | Katsuya et al. | 118/260 X |
| 4,668,537 | 5/1987 | Matsuyama et al. | 427/401 |
| 4,743,943 | 5/1988 | Adams, Jr. et al. | 399/325 |
| 4,751,548 | 6/1988 | Lawson | 399/325 |
| 4,757,347 | 7/1988 | Tamaoki et al. | 399/325 |
| 4,766,456 | 8/1988 | Pirwitz | 399/325 |
| 4,777,903 | 10/1988 | Wilcox | 118/60 |
| 4,793,041 | 12/1988 | Jenkins et al. | 492/37 |
| 4,942,433 | 7/1990 | Stuart | 399/326 |
| 5,047,809 | 9/1991 | Owada et al. | 399/325 |
| 5,132,739 | 7/1992 | Mauer et al. | 399/325 |
| 5,217,532 | 6/1993 | Sasame et al. | 118/60 |
| 5,232,499 | 8/1993 | Kato et al. | 118/244 |

10,000 AND 30,000 cST OIL LASER WICK EXPONENTIAL FITS

LASER WICK: 12g 10,000 cST vs. 30,000 cST WICK WEIGHT vs. # OF COPIES

RELEASE AGENT SUPPLY WICK FOR PRINTER APPARATUS AND METHOD FOR MAKING AND USING SAME

RELATED APPLICATIONS

The present application is a division of copending U.S. patent application Ser. No. 08/127,670 filed Sep. 28, 1993.

BACKGROUND OF THE INVENTION

1. Field of the Invention

The present invention relates to apparatus and method for supplying a release coating to a fixing roller or similar device such as those commonly found in printers and copiers.

2. Description of Related Art

A typical laser printer or plain paper copier contains a series of rollers used to fix toner in place once it has been transferred to paper. Generally the rollers comprise two rollers in contact with one another and rotating in opposite directions—a heated fixing roller and a resilient pressing roller. Once toner has been transferred to a sheet of paper, the paper is passed between the two rollers and toner is heat sealed in place.

In order to assure that the paper does not stick to the heated fixing roller during this procedure, a wick containing a release agent is mounted in contact with the roller along its length. A traditional wick has usually comprised a fibrous strip, such as one comprising NOMEX fiber sold by E. I. dupont de Nemours and Company, Wilmington, Del. These felts can be acquired from conventional industrial fabric suppliers such as Tex Tech industries of North Monmouth, Maine. The felt is presaturated with a release agent of silicone oil (e.g. dimethyl polysiloxane). In addition to assuring separation of the paper and fixing roller during the printing process, the wick also serves as a wiper to clean contaminants, such as residual paper dust, paper additives (e.g. clay, pigments) and offset toner, from the hot fixing roller.

While traditional felt/oil wicks enjoy widespread use due in part to their simplicity and relatively low cost, they are plagued with a number of problems. First, oil impregnated felt tends to provide inconsistent oil release, releasing excess quantities of oil upon initial installation and steadily diminishing to inadequate oil release over time. Second, felt tends to become clogged and caked with toner residue. Residue build up leads to: diminished ability of the felt to deliver oil; reduced effectiveness at cleaning the roller; and increased friction and wear upon the roller. Unfortunately, once contaminated, the matted surface of the felt makes it impractical to clean and requires its disposal. Third, the inability to clean the felt surface also makes it infeasible to attempt to regenerate the wick for reuse, leading to disposal problems and needless waste.

In recognition of some of these problems, a number of modifications to the basic wick design have been proposed. As is explained below, none is believed fully satisfactory.

In U.S. Pat. No. 4,668,537 issued May 26, 1987, to Matsuyama et al. it is proposed to adhere a strip of porous polymer membrane to a felt wick. While this addresses some of the problems inherent with use of a felt wick alone, there are a number of anticipated impediments with this approach. First, proper adhesion of a polymer membrane to a felt surface can be difficult to achieve and delamination in use is a distinct risk. Second, like use of a felt material alone, this device provides only a single contact surface against the fixing roller, which may be subject to premature wear and contamination. Third, the open nature of this device limits the amount of oil which can be loaded into the wick without leakage or clogging around the edge of the porous polymer strip.

Some of these concerns are addressed in U.S. Pat. No. 4,359,963 issued Nov. 23, 1982, to Saito et al. This patent teaches use of a elongated, relatively shallow bag of porous polymer, such as polytetrafluoroethylene (PTFE), filled with heat-resistant felt having silicone oil absorbed therein. Despite improved containment of the oil within the felt, most embodiments of this device continue to be problem prone, including: still supplying only a single contact surface between the wick and the fixing roller; requiring a somewhat difficult attachment of the polymer bag to a mounting frame; and presenting a risk of catastrophic oil leakage if the oil filled bag breaks. Another embodiment taught in this patent proposes use of a rotating polymer-covered felt wick. This approach may provide a better seal of the liquid within the felt, but the rotating movement of the wick against the fixing roller is believed to be less effective at cleaning the fixing roller surface and delivering oil onto the roller surface.

U.S. Pat. No. 4,375,201, issued Mar. 1, 1983, to Kato, employs a hollow tube of extruded porous PTFE which is filled with silicone oil and sealed or covered at both ends to prevent leakage. A coating of fluorocarbon rubber of other material is used to seal the pores in the PTFE tube in those areas not in contact with the fixing roller. While this applicator may address some of the problems of a felt and oil wick, as is discussed below it has a number of other deficiencies.

First, the use of a hollow tube containing a free-flowing reservoir of oil is unacceptable in many instances. For instance, the presence of a liquid reservoir means that the applicator must be kept level in order to have an even distribution of oil across the fixing roller. Additionally, the presence of oil in a free-flowing form presents a risk of leakage and damage to the equipment. To address the leakage problem, the patent teaches the use of sealing mechanisms on either end of the tube; however, such sealing mechanisms still present a risk of leakage and also add unnecessary bulk to the apparatus. Finally, with the loss of oil from the tube in the operation of the wick, undesirable distortion or collapse of the tube is possible.

Second, without the stability of a firm mass of felt or other material in contact with the roller, a hollow, tubular wick is believed to be less efficient at cleaning the roller than conventional felt-based wicks.

Third, the design of the apparatus of U.S. Pat. No. 4,375,201 is believed to add little in the way of increased operational life to the apparatus. Although the device appears capable of refill, this procedure may be far too cumbersome and prone to leakage for widespread acceptance. This conclusion is bolstered by the patent's suggestion that the device may be disposed of after use. Further, in order to avoid leakage, the pores of the applicator are intentionally sealed around most of its periphery to provide only a single roller contact surface. This allows the applicator to be used only so long as this single surface area can be maintained free from wear and residue build-up.

Similar devices are disclosed in U.S. Pat. No. 4,573,428 issued Mar. 4, 1986, to Ogino et al. and U.S. Pat. No. 4,631,798 issued Dec. 30, 1986, Ogino et al. Both of these devices employ sealed porous polymer tubes filled with a free-flowing liquid release agent. As such, each is believed to suffer from deficiencies similar to those discussed above. Further, the use of a polyethylene in U.S. Pat. No. 4,573,428 is believed to have a number of additional problems, such as uneven pore structure, increased risk of clogged pores, and possible contamination of heated fixing rollers.

A more complex wick apparatus is disclosed in U.S. Pat. No. 4,459,625 issued Jul. 10, 1984, to Sakane et al. This apparatus provides an open reservoir of release agent which can be repeatedly refilled. Unfortunately, this applicator continues to have only a single contact surface while being substantially bulkier than any of the previously referenced devices. Additionally, the use of free-flowing liquid also presents serious leakage and operational limitations. Finally, this device requires relatively complex assembly techniques in order to create an adequate seal between the roller surface contact and the oil reservoir.

Another problem which has emerged more recently centers around the demand for small, portable high-quality printers and copiers. The particular demands in storage and use inherent in the portable market eliminates use of any release coating applicator which must be maintained in a upright, much less level position. Additionally, the size and weight demands for such equipment requires that whatever device is used, it be as light, compact and durable as possible.

Accordingly, it is a primary purpose of the present invention to provide an apparatus for applying release chemicals to a roller which is durable, delivers a consistent coating of chemical to the roller, and provides effective cleaning of the roller.

It is a further purpose of the present invention to provide such an apparatus which has improved operational life by being readily adjusted to position multiple contact surfaces between apparatus and the roller.

It is yet another purpose of the present invention to provide an apparatus for applying release chemicals to a roller which is not prone to leakage and which can effectively operate at other than level orientations.

It is still another purpose of the present invention to provide an apparatus for applying release chemicals to a roller which can be readily cleaned and reconditioned for reuse.

It is an additional purpose of the present invention to provide straightforward methods to produce and use an applicator with these properties.

These and other purposes of the present invention will become evident from review of the following specification.

SUMMARY OF THE INVENTION

The present invention provides an improved applicator apparatus for use in delivering release agent to fixing rollers or similar devices in a variety of printers, including laser printers, plain paper copiers and facsimile machines, etc.

The applicator apparatus of the present invention comprises: an absorbent textile core, such as twisted fiberglass rope or cord, filled with release agent; a permeable membrane, such as expanded polytetrafluoroethylene, surrounding the textile core to form a sheathed wick member; and a mounting sleeve for retaining the sheathed wick member in contact with a fixing roller. Preferably, the sheath wick member comprises an essentially cylindrical unit open at each end which can be rotated to position different faces in contact with the fixing roller.

In operation, the apparatus is mounted in contact with a fixing roller in a conventional manner to provide a regular coating of release agent to the fixing roller while continuously removing excess toner and other contaminates from the roller. Once the sheathed wick member has become loaded with contaminates or begins to experience decreased oil delivery, it can be repositioned within the mounting sleeve to present a different face in contact with the fixing roller.

The applicator apparatus of the present invention provides a far more constant and longer-lived coating of release agent than has been previously available with conventional felt wick applicators. Moreover, the applicator of the present invention can be readily cleaned and regenerated for additional use once expended. Finally, the applicator of the present invention is durable, requires minimal space, and can be stored, transported and operated at different angles with minimal risk of spillage or damage to printer.

DESCRIPTION OF THE DRAWINGS

The operation of the present invention should become apparent from the following description when considered in conjunction with the accompanying drawings, in which.

DETAILED DESCRIPTION OF THE INVENTION

The present invention provides an improved apparatus for use in delivering a chemical agent to a roller. The apparatus of the present invention is particularly applicable to the delivery of a release agent such as silicone oil to a fixing roller of a laser printer, plain paper copier or fax machine, or similar device. For simplicity, such devices will be collectively referred to herein as "printers."

Figure 1:
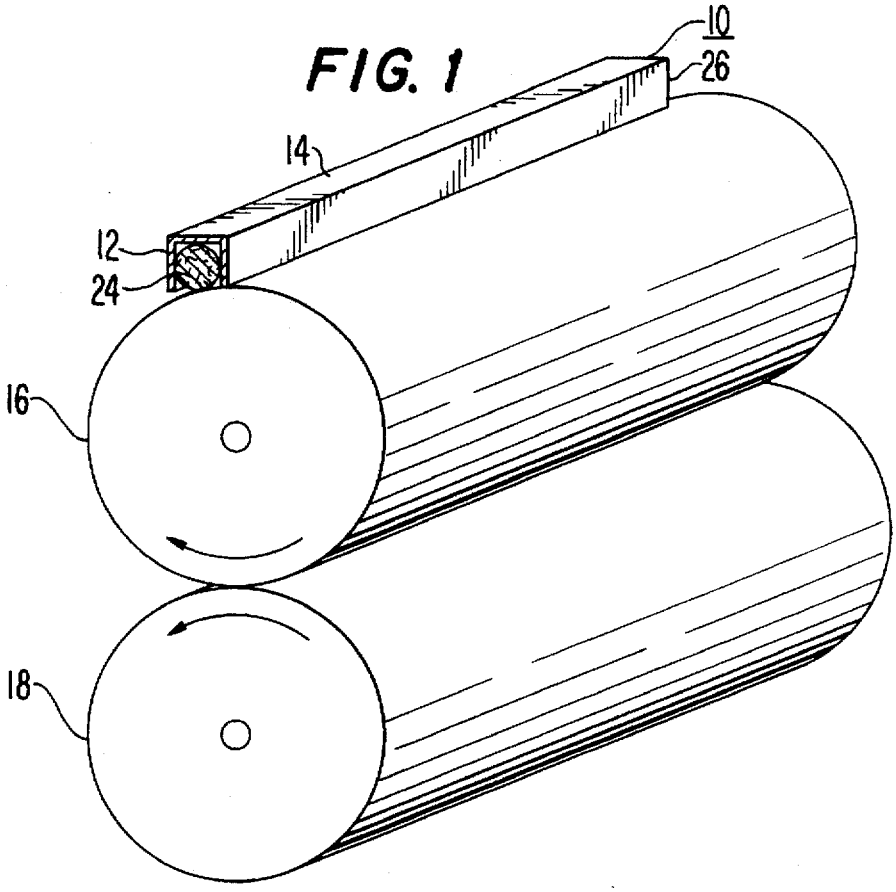
FIG. 1 is a three-quarter isometric view of one embodiment of a release agent applicator of the present invention shown oriented with fixing and pressing rollers.
Figure 2:
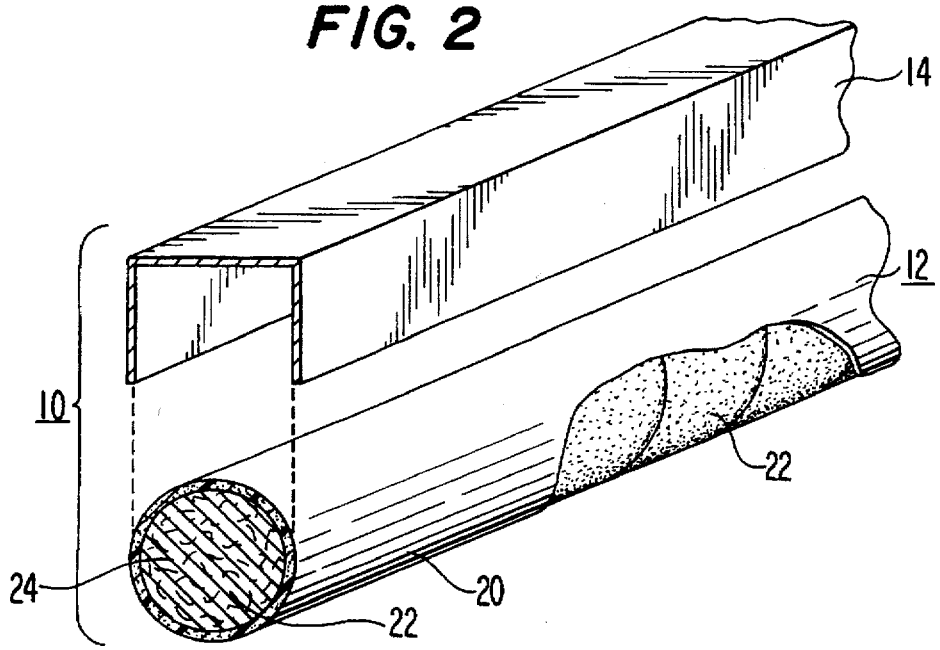
FIG. 2 is an enlarged, three-quarter exploded view of a sheathed wick member of the present invention and a mounting sheath, the sheath wick member shown with a portion of its porous membrane surface cut-away.

As is shown in FIGS. 1 and 2, the release agent delivery apparatus 10 of the present invention comprises a sheathed wick member 12 and a mounting sleeve 14. As is shown in FIG. 1, the apparatus 10 is mounted to place the sheathed wick member 12 in contact with a fixing roller 16 of a printer. The fixing roller 16 in turn is in direct contact with a resilient pressing roller 18. As is known, once an image has been applied to a piece of paper, the paper passes between the fixing roller 16 and the pressing roller 18 to seal toner to the paper.

In order to prevent the paper from attaching itself to the fixing roller 16, the release agent delivery apparatus 10 provides a coating to the fixing roller 16 on each revolution of the roller. Suitable release coatings for most applications include a silicone oil, such as polydimethylsiloxane. The delivery apparatus 10 also serves to wipe any excess toner or other residue or dust from the fixing roller 16 to avoid contamination of future printer pages.

The sheathed wick member 12 of the present invention comprises a permeable polymer membrane 20 completely surrounding an absorbent textile core 22. The polymer membrane 20 should be sufficiently porous to release agent that such release agent will pass readily through it when it is compressed against a fixing roller 16 in normal operation. Preferably the membrane 20 comprises a tube or tape of fluoropolymer and especially a fluoropolymer of polytetrafluoroethylene (PTFE). Permeable membranes of PTFE can be derived through a number of processes, including by forming an expanded network of polymeric nodes and fibrils in accordance with the teachings of U.S. Pat. No. 3,953,566 issued Apr. 27, 1976, to Gore. This material is commercially available in a variety of forms from W. L. Gore & Associates, Inc. of Elkton, Md., under the trademark GORE-TEX.

Generally, a seamless tubular membrane should have the following properties: a thickness of about 0.002 to 0.125 inches; a porosity of about 30 to 98%; and a bubble point (with isopropyl alcohol) of 0.4 to 60 psi. The preferred tubular membrane properties are: a thickness of about 0.03 to 0.04 inches; porosity of about 70 to 80%; and a bubble point of about 3–5 psi.

The Bubble Point of porous PTFE was measured using a method similar to that set forth in ASTM Standard F316-86, with the following modifications: isopropyl alcohol was used instead of denatured alcohol; area tested was about 10 mm diameter (78.5 $mm^2$). The Bubble Point is the pressure of air required to blow the first continuous bubbles detectable by their rise through a layer of isopropyl alcohol covering the PTFE media.

For a fluorinated ethylene propylene (FEP) coated tape membrane, the membrane should have the following properties: a thickness of about 0.0005 to 0.125 inches; and a porosity of about 30 to 98%. Preferably, a tape thickness is about 0.001 to 0.002 inches and a porosity of about 80 to 95%.

An expanded PTFE membrane is preferred for a variety of reasons. First, the chemical inertness and relatively high heat resistance of PTFE makes it completely suitable for use as part of a wick in a printer environment. Second, expanded PTFE provides even distribution of release agent. Additionally, the rate of distribution of release agent can also be tightly controlled by adjusting the dimensions and porosity of the expanded PTFE membrane-assuring more uniform dissemination of release agent over the operative life of the delivery apparatus. Third, expanded PTFE has a low coefficient of friction and exceptional wear characteristics, reducing wear on component parts and extending operational life of the apparatus. Fourth, PTFE can be readily cleaned of deposited toner and other contaminates, again extending the operative life of the apparatus.

A preferred tape membrane for use with the present invention comprises an expanded PTFE material coated with a thermoplastic polymer with a melting temperature below that of the expanded PTFE. The thermoplastic layer should be ½ to 1/10 or less of the thickness of the PTFE material. The PTFE and thermoplastic polymer composite is heated to a temperature sufficient to soften or melt the thermoplastic polymer into the expanded PTFE surface but below that which will melt the PTFE (i.e. below about 342° C.). Thermoplastic polymers are preferred since they are similar in nature to PTFE (i.e. they have melt points near the lowest crystalline melt point of PTFE, and they are relatively inert in nature and therefore resist chemical attack). Suitable thermoplastic polymers for use with the present invention may include: fluorinated ethylene propylene (FEP), copolymer of tetrafluoroethlene and perfluoro(propylvinyl ether) (PFA), homopolymers of polychlorotrifluoroethylene (PCTFE) and its copolymers with tetrafluoroethylene (TFE) or vinylidene fluoride, ethylenechlorotrifluoroethylene (ECTFE) copolymer, ethylene-tetrafluroethylene (ETFE) copolymer, polyvinylidene fluoride (PVDFG), and polyvinylfluoride (PVF).

The preferred material for use as a tape in the present invention is a composite fluoropolymer film/membrane comprising a noncontinuous thermoplastic fluoropolymer layer (more preferably a non-continuous layer of fluorinated ethylenepropylene (FEP)) and an expanded PTFE layer.

The porous membrane is laid on the core 22 with the thermoplastic layer facing the core 22. Wrapping the wick with the porous membrane may be done by hand either spirally or in a "cigarette" fashion. Wrapping is preferably accomplished using a spiral tape wrap machine such as those known in the art of wrapping dielectric layers around conductors. One such machine is taught in U.S. Pat. No. 3,756,004 to Gore. The tape wrap machine applies the porous membrane with back tension in a helical fashion around the PTFE core. Back tension allows oil from the core to wet-out the tape rapidly.

The resulting composite material is heated to a temperature above the melt point of the thermoplastic fluoropolymer layer and at or below about 350° C. so that the contacting layers of the membrane adhere. The material should be kept under tension when heated. Heating can be done through any common method, including use of conduction or convection heat.

Housed within the membrane 20 is an absorbent textile core 22 which is filled with release agent. The textile core 22 may be a twisted or braided rope of fibrous strands which will provide a substantial reservoir of release agent. Additionally, the textile core 22 should be sufficiently resilient to deformation so as to provide support to the membrane 20 when it is placed in contact with roller 16. Other possibly suitable textile materials include cords, yarns, tow, silver, fabric, or felt. These may be constructed from materials such as fiberglass, aramids, copolyimides, polyimides, fluoropolymers (e.g. chlorotrifluoroethylene (CTFE) or polytetrafluoroethylene (PTFE)), polyphenylene sulfide (PPS), modacrylic, novoloid, polyester, acrylic, or similar materials or combinations or blends of such materials. Additionally, the textile core may comprise an open cell foam, such as silicone, urethane, melamine, fluoropolymer, and mixtures thereof. The primary concern is to select a material which is suitable for use in a printer environment (e.g. being resistant to attack by the release agent; being able to handle operating temperatures of the fixing roller; etc.).

The membrane 20 illustrated in FIG. 2 comprises a continuous tube of expanded PTFE placed around textile core 22. This construction may be achieved by any conventional means, including by extruding membrane 20 around the textile core 22 or by pulling the textile core 22 into the membrane 20. The textile core 22 may be filled with the release agent prior to insertion into the membrane 20, or it may be filled after insertion by injection under pressure or vacuum or by merely soaking the sheathed wick member 12 within a release agent material.

It has been found that the textile core 22 provides a sufficiently absorbent substrate so that the release agent will remain therein without conscientious sealing of the membrane 20 around the textile core 22. As such, each end 24, 26 of the sheathed wick member 12 may be left open. Although not necessarily required, this open construction provides a number of benefits, including giving easy access for replenishing release agent; limiting the size of the sheathed wick member 12 to only its operational length—eliminating additional space which might be required for end caps or other sealing means; reducing labor and material costs for construction; etc. An additional benefit is that open ends allow the unit to pressure equalize (i.e.. to function properly, sealed units should include added means to achieve pressure equalization, or else the flow of oil from the unit will steadily decrease due to vacuum formation within the unit).

The delivery apparatus 10 may be mounted in contact with the fixing roller 16 in any suitable manner. As is known, most printer devices include clips or brackets adapted to receive a wick and retain it in contact with the fixing roller 16. It should be evident from the above description that the mounting sleeve 14 of the present invention can be readily provided with appropriate hardware to interface with such mounting systems.

Figure 3:
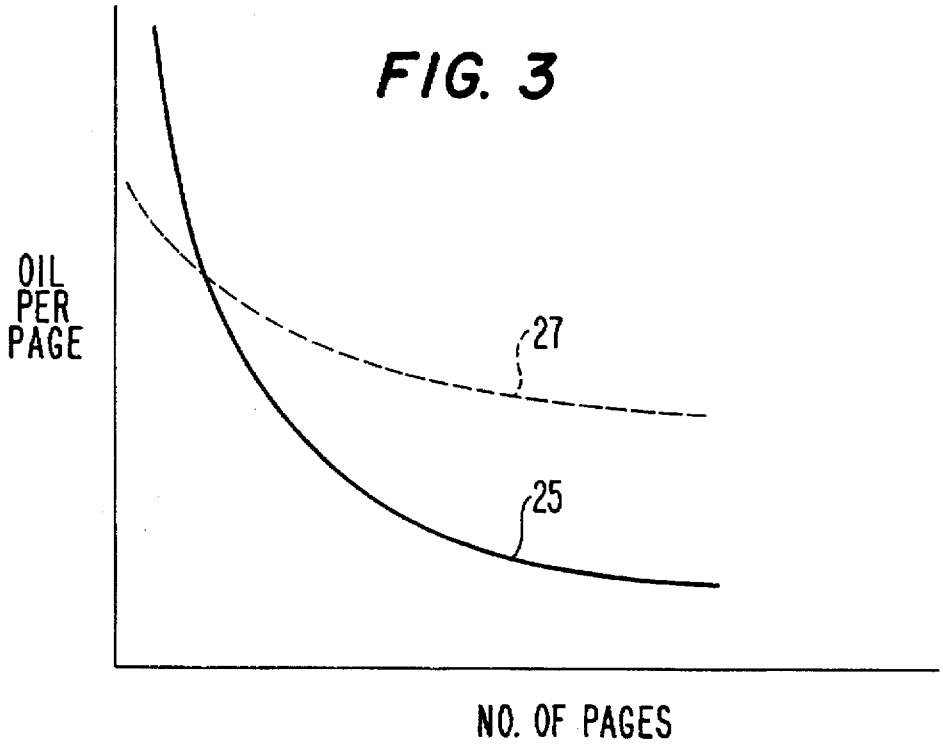
FIG. 3 is a graph illustrating release agent delivery versus number of pages printed of a conventional felt and silicone oil wick and a wick of the present invention.

Shown in FIG. 3 is a hypothetical graph depicting the relative delivery of release agent per page over a number of pages for a conventional felt/oil wick 25 and a sheathed wick member 27 of the present invention. As can be seen by this graph, a conventional wick tends to provide far too much oil upon immediate installation and then falls off rapidly to provide too little oil. By contrast, a wick of the present invention provides a more consistent oil coating to the fixing roller over its operational life, and, as a result, should tend to have an extended duty cycle, and provide better image quality.

Figure 4:
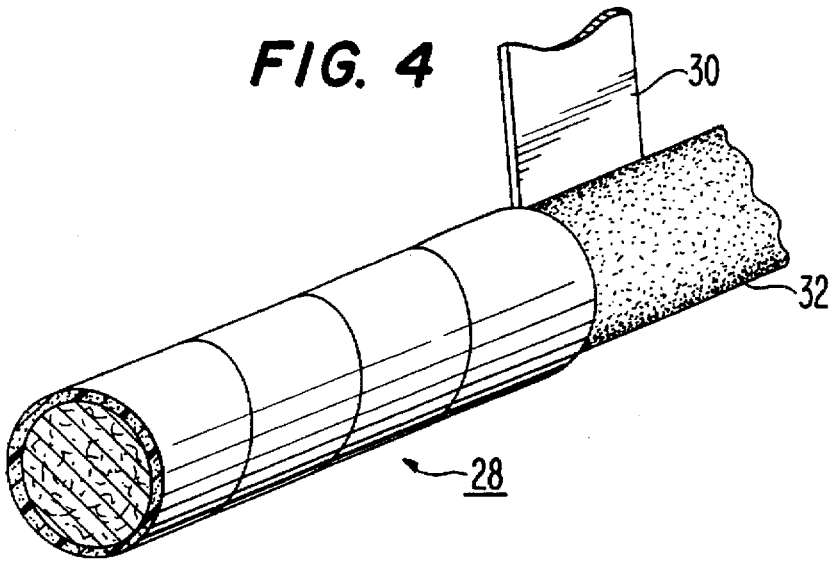
FIG. 4 is an enlarged, three quarter isometric view of another embodiment of a spiral-wrapped sheathed wick member of the present invention.

Another embodiment of a sheathed wick member 28 of the present invention is shown in FIG. 4. In this form, the wick member 28 is formed by spiral wrapping a porous membrane 30 around a textile core 32 in the manner described above.

A composite tape of expanded PTFE membrane and FEP tape with the following properties is preferred. The tape is ideally a porous, non-continuous FEP coated expanded PTFE tape which has been highly expanded in the machine direction about 80:1 or more. The high degree of expansion imparts high strength to the material in the direction of expansion. Overall dimensions of the tape is preferably about 1 inch wide and 0.001 to 0.005 inch thick. The tape is applied to the core with an overlap of about ½ (i.e. covering the core about two times).

The textile core 32 in the embodiment of FIG. 4 comprises a 0.0374 inch diameter matrix braid fiberglass rope with a base weight of about 30 grams/foot. The rope is impregnated with silicone oil (e.g. DOW 200 fluid).

Figure 5:
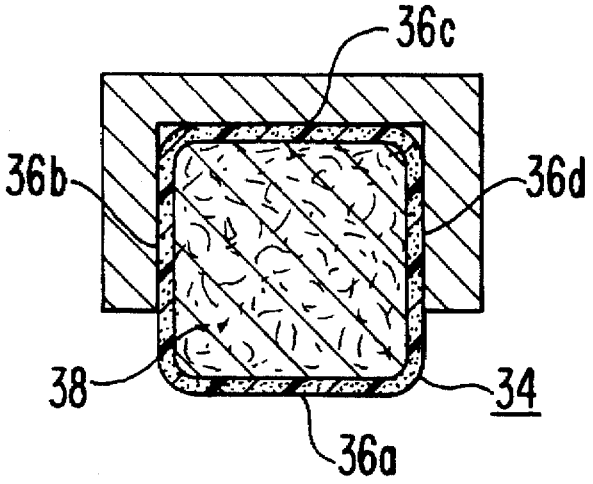
FIG. 5 is a cross-sectional view of yet another embodiment of a sheathed wick member and mounting sleeve of the present invention.
Figure 6:
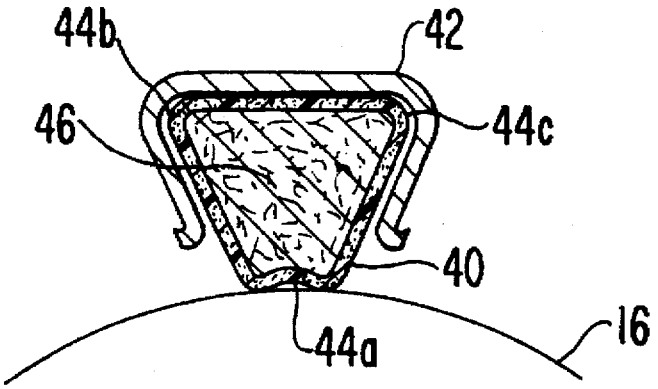
FIG. 6 is a cross-sectional view of still another embodiment of a sheathed wick member and mounting sleeve of the present invention.

Other examples of possible embodiments of the sheathed wick members of the present invention are illustrated in FIGS. 5 and 6. The embodiment of FIG. 5 demonstrates that the sheathed wick member 34 can be formed in an essentially rectangular shape. This form has a number of advantages in that it provides an extended contact surface **36*a* against which to contact a fixing roller 16. With the use of a resilient textile core material 38, such as needle punched felts, tow fiber, or open cell foams, the contact surface would be expected to conform somewhat to the shape of the fixing roller for improved cleaning and release agent application. As should be evident, the sheathed wick member 34 may be readily removed and reinserted to provide up to four fresh contact surfaces 36*a*, 36*b*, 36*c*, 36*d*** before the wick member must be cleaned or replaced.

The embodiment shown in FIG. 6 is yet another example of a sheathed wick member 40. In this form, the sheathed wick member 40 comprises an essentially triangular shape which is retained in place by contoured mounting sleeve 42. Preferably, the wick member 40 is mounted against the fixing roller 16 to place its pointed ends **44*a*, 44*b*, 44*c* in contact with the fixing roller 16. Again, the textile core 46** material should comprise a deformable material, such as a needle punched felt or an open cell foam, to improve surface contact area.

It should be evident from these examples that a wide variety of other shapes may likewise be provided for the sheathed wick member and mounting sleeve of the present invention without departing from its intent.

One of the advantages of the apparatus 10 of the present invention is that it can be cleaned and regenerated for further use. The preferred cleaning and regenerating steps comprise wiping the collected residue from the surface of the wick using an absorbent cloth. The core is then re-injected with silicone oil, either manually with a syringe or automatically with a pressurized oil delivery syringe system.

A simplified procedure for regenerating the wick comprises simply rotating the sheath and core approximately 90 degrees and then, if necessary, re-injecting with silicone oil as described above.

Without intending to limit the present invention, the following represent examples of sheathed wick members which were made and used in accordance with the present invention:

EXAMPLE 1

An expanded porous polytetrafluoroethylene tubing with an outer diameter of about 9 mm and an inner diameter of about 7 mm was used to make fuser oil application wicks for a laser printer. Each tube was filled with a core of various material and filled with a DOW CORNING 200 silicone oil acquired from Dow Corning Corp. of Midland, Mich.

Samples were prepared in the following manner:

For a core of polyester felt (poly felt), 2720 g/m$^2$ (65 oz/yd$^2$) by 9.5 mm (⅜") thick polyester felt was cut into 9.5 mm×6.4 mm×28 cm (⅜"×⅜"×11") strips. These strips were weighed and evenly coated with 12 grams of DOW CORNING 200 silicone oil fluid (10,000 centistoke). The oiled strips were placed horizontally on a glass dish so that the oil could evenly distribute throughout the polyester felt. The oiled felt was then pulled through a 38 cm (15") long expanded PTFE tube. Pulling through the tube was accomplished by attaching a safety pin to the felt and tying a metal wire to the safety pin and passing the wire through the tube. Once the expanded PTFE tube was pulled over the oiled felt, both the tube and the felt were cut to 21.6 cm (8.5") in length and weighed.

Wicks prepared in accordance with the above procedures were then tested with various weights and viscosities of silicone oils in a drip test. Each sample was clamped in a ring-stand and hung vertically for a period of days. A paper towel was placed below the hanging sample to catch any oil that flowed out. Drips of oil that were observed on the paper towel were noted. Wicks "passed" the drip test when absolutely no drips were observed after ten (10) days. No dripping is desirable to ensure that the proper amount of oil is transferred during the operation of the copier. Drip tests were conducted by varying the material, oil weight, and oil viscosity. The following results were observed:

WICK DRIP DATA

| Sample No. | Material | Oil Wt. (g) | Oil Viscosity (Centistokes) |
|---|---|---|---|
| 1 | Fiberglass rope | 12.0 | 30,000 |
| 2 | Polyester felt | 12.2 | 30,000 |
| 3 | NOMEX felt | 12.3 | 30,000 |
| 4 | Poly felt | 12.7 | 10,000 |
| 5 | Poly felt | 6.3 | 10,000 |
| 6 | NOMEX felt | 12.1 | 10,000 |
| 7 | NOMEX felt | 6.5 | 10,000 |
| 8 | Fiberglass rope | 6.3 | 10,000 |
| 9 | Fiberglass rope | 12.1 | 10,000 |
| 10 | MELAMINE foam | 6.0 | 30,000 |

Each of the materials of Samples Nos. 1 through 9 were installed within expanded PTFE tubes in the manner described above. After ten days, no oil drips were observed from any of Samples Nos. 1 through 8. Sample 9 did experience dripping after ten days and is considered to have "failed" the drip test. Sample 10 also failed the drip test, with dripping beginning after only 24 hours.

Figure 7:
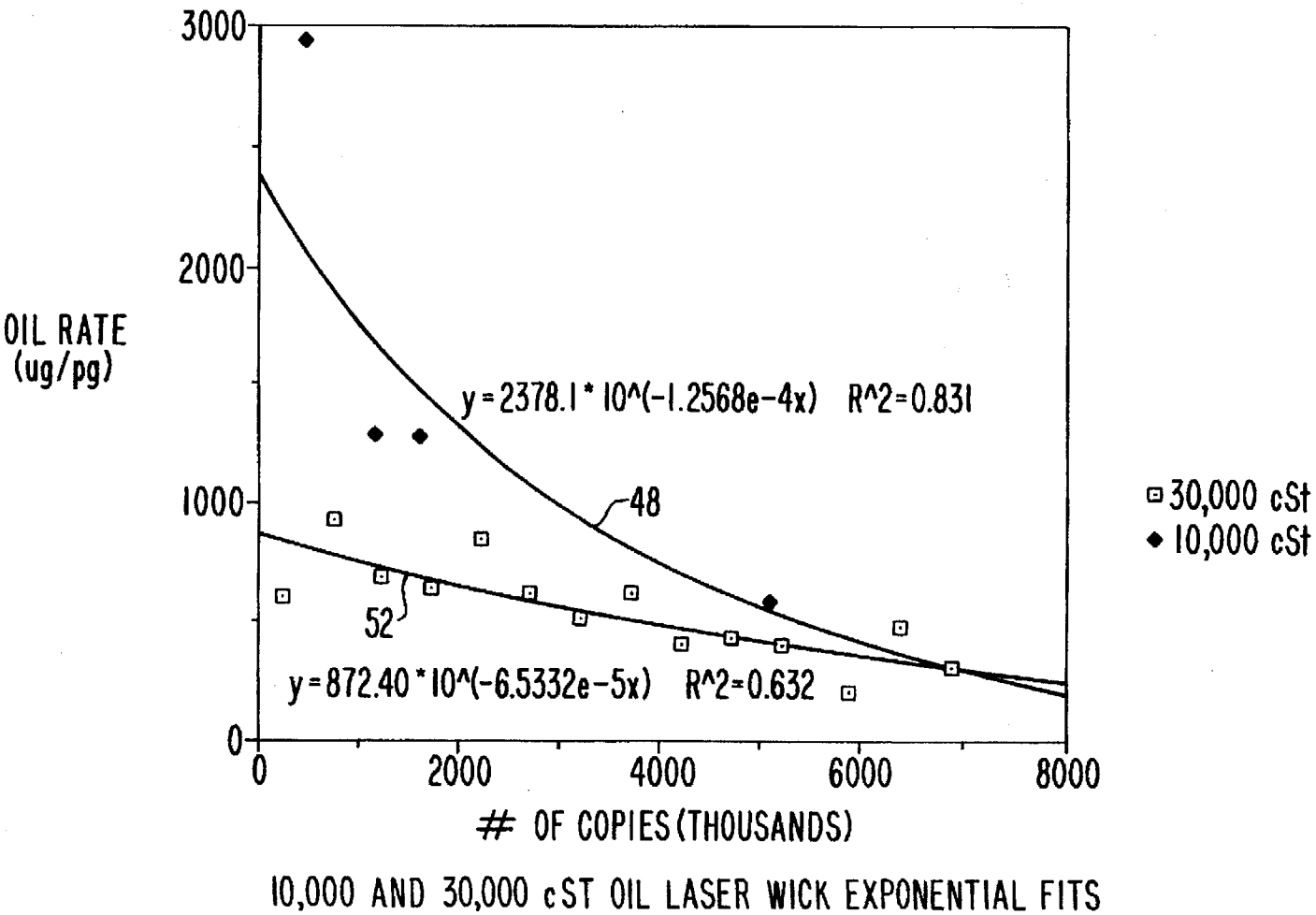
FIG. 7 is a graph depicting the rate of oil distribution versus number of copies generated on a laser printer for two different wick members of the present invention.
Figure 8:
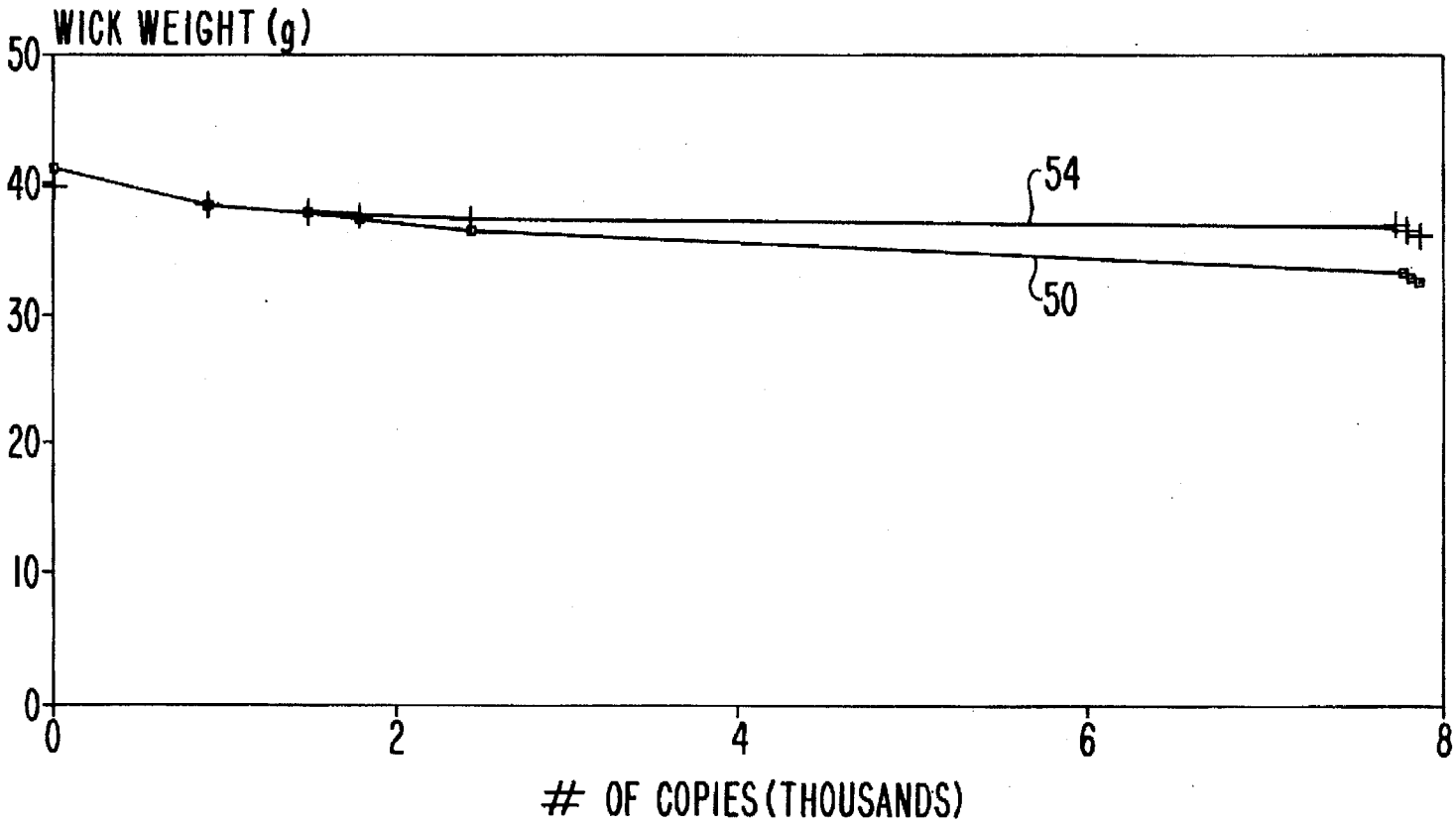
FIG. 8 is a graph depicting changes in wick member weight as a function of number of copies generated on a laser printer for two different wick members of the present invention.

To test the wick's functionality, pre-weighed wicks similar in construction to that of Sample 2 and 4 above were inserted into a QMS PS820 laser printer. A total of 8,600 copies were generated with these wicks in place. After various numbers of intermittent copies were run, including as few as 20 copies and as many as 900 copies, the wicks were removed from the printer and re-weighed. By taking difference in the weights before and after the copies were run, the intermittent and total oil transfer rates were calculated. Graphs of wick weight verse number of copies and of oil delivery rate verses number of copies were produced in order to quantity the oil transfer as a function of the printer runs. These results are plotted as lines 48 and 52 on the graph of FIGS. 7. The weight loss of the wick as a function of the number of copies printed is shown as lines 50 and 54 on the graph of FIG. 8. Transfer rates were considered somewhat higher than desired.

EXAMPLE 2

A polyester felt of 2720 g/cm$^2$ basis weight with a thickness of 9.5 mm was again cut into 9.5 mm×6.4 mm×12.7 cm strips. The strips were pulled through ePTFE tubbing using the safety pin and metal wire procedure previously described. Once the felt was installed in the tubing, the felt was oiled using 12.04 g of DOW CORNING 200 fluid 30,000 centistoke silicone oil. Oil was injected at both ends using a 12.7 cm (5") long needle and syringe. The oiled sample was then placed horizontally on a glass dish to allow the oil to flow evenly through the sample. The oiled sample was then cut to 21.6 cm (8.5") in length and was weighed.

After passing the drip test, the oiled wick was again placed in a QMS PS820 laser printer, and an total of 7,100 copies were generated, After every 500 copies, the wick was removed and re-weighed in order to calculate the total and intermittent oil transfer rates. This trial resulted in an oil transfer rate significantly lower than that achieved in Example 1. The oil transfer rate was considered acceptable for use in a printer device.

While particular embodiments of the present invention have been illustrated and described herein, the present invention should not be limited to such illustrations and descriptions. It should be apparent that changes and modifications may be incorporated and embodied as part of the present invention within the scope of the following claims.

The invention claimed is:

1. A release agent delivery apparatus adapted to be mounted against a roller which comprises an absorbent textile core filled with release agent;

a tubular permeable membrane of polytetrafluoroethylene (PTFE) surrounding the textile core to form a sheathed wick member with open ends; and a mounting sleeve adapted to receive the sheathed wick member and retain the wick member in contact with the roller, wherein the sheathed wick member is readily removable from the sleeve and adapted to be reinserted therein with a different surface in contact with the roller.

2. The apparatus of claim 1 wherein the absorbent textile core comprises a fibrous rope material.

3. The apparatus of claim 2 wherein the fibrous rope is selected from the group consisting of fiberglass, polyimide, copolyimide, polyphenylene sulfide, polytetrafluoroethylene, chlorotrifluoroethylene, polyester, acrylic, modacrylic, aramid, and novoloid.

4. The apparatus of claim 1 wherein the permeable membrane comprises a sheet of expanded PTFE.

5. The apparatus of claim 4 wherein the sheet of expanded PTFE comprises a tape wrapped around the wick.

6. The apparatus of claim 1 wherein the permeable membrane comprises a continuous tube of expanded PTFE surrounding the wick.

7. The apparatus of claim 1 wherein the permeable membrane includes a coating of fluorinated ethylenepropylene (FEP).

8. A release agent delivery apparatus adapted to be mounted against a roller which comprises a sheathed wick member including an absorbent textile core filled with release agent, and a tubular permeable membrane of polytetrafluoroethylene (PTFE) surrounding the textile core; and a mounting sleeve adapted to receive the sheathed wick member and retain a first contact surface of the wick member in contact with the roller;

wherein the sheathed wick member is readily removable from the sleeve and adapted to be reinserted therein with a different surface in contact with the roller.

9. The apparatus of claim 8 wherein the sheathed wick member includes at least one open end.

* * * * *